United States Patent [19]

Goll

[11] 3,986,066

[45] Oct. 12, 1976

[54] ELECTRON BEAM GENERATING SYSTEM WITH CATHODE

[75] Inventor: Erwin Goll, Einsingen, Germany

[73] Assignee: Licentia Patent-Verwaltungs-G.m.b.H., Frankfurt am Main, Germany

[22] Filed: Apr. 30, 1975

[21] Appl. No.: 573,091

[30] Foreign Application Priority Data

May 11, 1974 Germany ..... 2422884

[52] U.S. Cl. ..... 313/251; 313/256; 313/261; 313/284; 313/281; 315/3.5; 313/417; 313/451

[51] Int. Cl.[2] ..... H01J 1/88; H01J 19/42

[58] Field of Search ..... 313/417, 451, 256, 251, 313/284, 285, 258, 260, 261, 281; 315/3.5 X, 3.5

[56] References Cited

UNITED STATES PATENTS

| | | | |
|---|---|---|---|
| 2,567,893 | 9/1951 | Pohle et al. | 313/451 X |
| 2,957,999 | 10/1960 | Gaylord | 313/285 X |
| 2,958,800 | 11/1960 | Wallace | 315/3.5 X |
| 2,991,391 | 7/1961 | Beaver | 315/3.5 |
| 3,214,625 | 10/1965 | Katz | 313/260 |
| 3,227,913 | 1/1966 | Disman et al. | 315/3.5 |
| 3,567,988 | 3/1971 | Randmer et al. | 313/285 |

*Primary Examiner*—Saxfield Chatmon, Jr.
*Attorney, Agent, or Firm*—Spencer & Kaye

[57] ABSTRACT

In an electron beam generating system including a cathode, a Wehnelt electrode, an anode, three groups of at least two electrically conductive rods, the rods of each group being connected to a respective one of the cathode, the Wehnelt electrode and the anode, a plurality of electrically insulating members each holding a respective rod, and a metal disc to which the insulating members are fastened in a manner to insulate each rod from the disc and from the other rods, the disc is made in the form of a circular ring provided with a central opening and at least six additional openings disposed around the central opening, the insulating members are tubular members each having a central bore and each projecting from both sides of the disc, and each rod is inserted in the bore of a respective insulating member, and extends at least partially through, and is fastened to, its respective insulating member.

11 Claims, 3 Drawing Figures

ELECTRON BEAM GENERATING SYSTEM WITH CATHODE

BACKGROUND OF THE INVENTION

The present invention relates to an electron beam generating system of the type including a cathode, a Wehnelt electrode, an anode and possibly further electrodes which are each fastened to a metal disc with at least two metal rods, and with insulating pieces being set therebetween.

In one known configuration for electron beam generating systems of traveling field tubes, individual electrodes are equipped with annular flange-type parts which are spaced apart by insulating rings. In such systems it is possible for the insulating rings and the annular flange portions to additionally serve as the vacuum envelope. In such electron beam systems there exists the drawback, however, that the structure is relatively complicated because the electron beam system itself can be prefabricated only with difficulty and the many resulting annular cavities make evacuation of the finished tube very time consuming.

It has also been attempted to mount the individual electrodes in beam generating systems in some other way. This however always creates difficulties with respect to stability and shock resistance of such tubes. The latter, however, are of particular importance if the tubes are microwave tubes which are to be used, for example, in airborne bodies such as satellites.

SUMMARY OF THE INVENTION

It is therefore an object of the present invention to provide a novel electron beam generating system which has a high mechanical stability, and together therewith high shock resistance, which remains well insulated over long periods of operation, which does not substantially hamper rapid evacuation of the tube, and which can, due to its poor heat conductivity, be operated with relatively little heat production from the cathode.

This and other objects according to the present invention are achieved by a generating system composed of a metal disc in the form of a circular ring having at least six peripheral openings arranged around a central opening, tubular insulating parts fastened in the peripheral openings to protrude from the metal disc at both sides thereof, metal rods, which support electrodes, fastened to the tubular insulating parts and extending at least partially therethrough.

A preferred field of application for the above-described electron beam generating system is in satellite traveling field tubes. The advantage of the electron beam generating system according to the invention is its high mechanical stability, its high electrical insulation stability, its favorable gas permeability with respect to the production and maintenance of a vacuum, and its ability to be prefabricated in a simple manner and to then be introduced into the tube as a finished component.

DESCRIPTION OF THE PREFERRED EMBODIMENTS

Figure 1A:
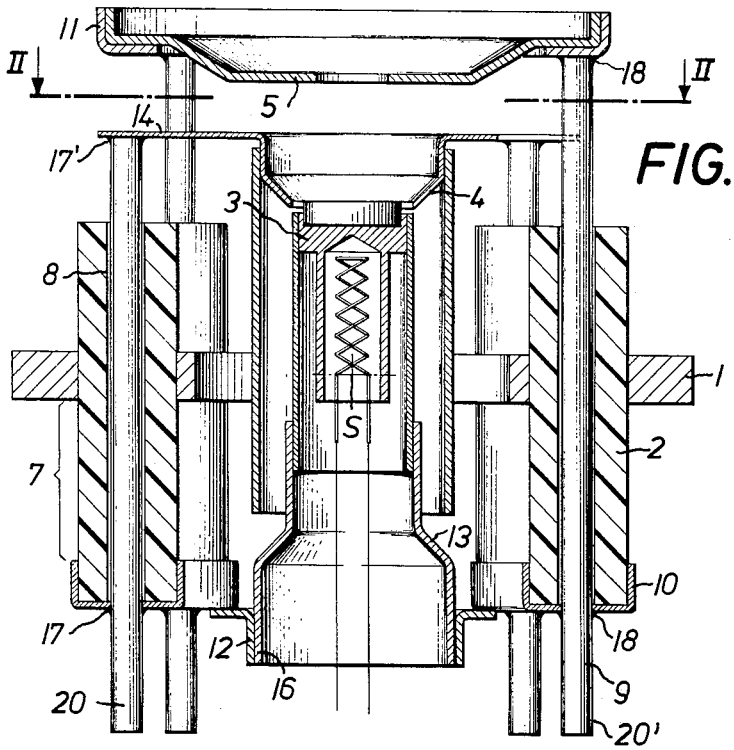
FIG. 1*a* is an elevational, cross-sectional view of a preferred embodiment of the invention, along the line C-D of FIG. 2.
Figure 1B:
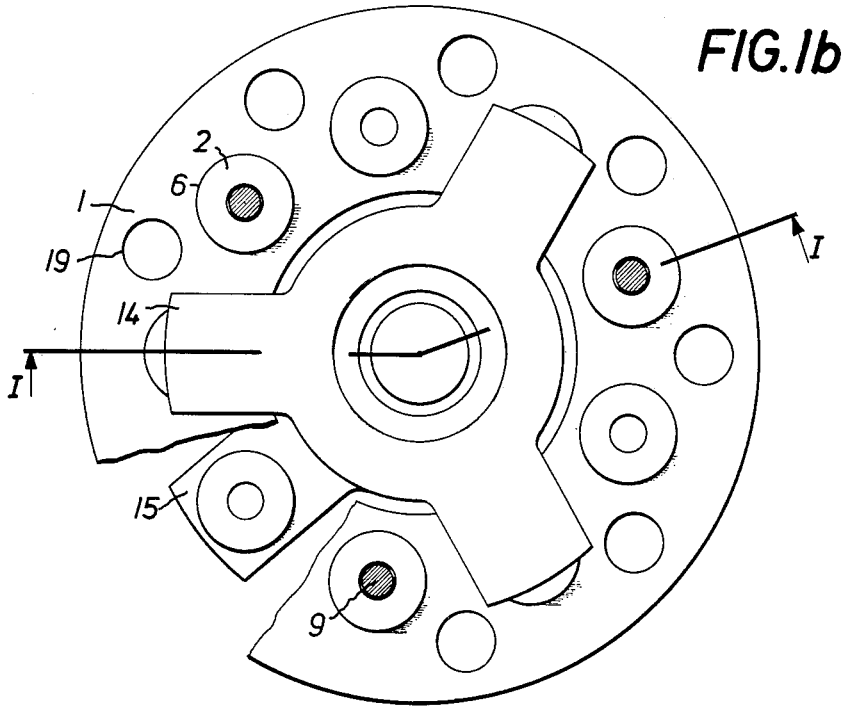
FIG. 1*b* is a cross-sectional view along line A-B of FIG. 1.

FIGS. 1*a* and 1*b* show a system including a metal disc 1 which is provided with a central opening and bores 6 arranged around the central opening to accommodate three insulating tubes 2 for each of a cathode 3, a Wehnelt electrode 4 and an anode 5. The insulating tubes 2 are soldered into these bores 6, which are angularly offset by 40° to one another, so that the length of the tubes produces an insulating path 7 which is sufficient to insulate against the electrical voltages applied later during operation of the system. The insulating tubes 2 may preferred consist of an alumina ceramic with a high $A2_2O_3$ content. The solder may be an eutectic AgCu or preferred NiAu (for example 16 % Ni, 84 % Au in weight percent) solder.

The wehnelt electrode 4 has three tabs 14 and the anode 5 includes an anode carrier 11. Electrode 4 is supported by three circular rods 9, lying on a circle and offset from one another by 120°, each rod supporting a respective tab 14. Similarly, anode carrier 11 is supported by three rods 9 located on the circle and angularly spaced 120° apart. The rods 9 of anode 5 are interposed between those rods supporting electrode 4. Each rod 9 is inserted through the internal bore 8 in a respective insulating tube 2 and is soldered to a respective metal cap 10 and insulating tube 2.

At the other end, the circular rods 9 are soldered to the Wehnelt electrode 4 and to the anode carrier 11, which is designed for insertion of anode 5.

The cathode 3 is provided with a support 12 formed with angularly spaced tabs 15 and a cathode carrier 13 having a neck 16 disposed in the center of the cathode support 12, into which neck the cathode carrier 13 is welded. Tabs 15 are soldered to caps 10 at three of the insulating tubes 2 which are offset, on the circle, by 120° from one another.

In this arrangement three fixed soldering points 17 or 17' and 18 or 18', respectively, are disposed angularly offset by 120° from one another on the circle, points 17' and 18' being at opposite ends of rods 9 from points 17 and 18. There is thus formed a statically defined configuration for holding the individual electrodes of the system, which condiguration meets the strictest requirements with respect to shaking and vibration resistance while having as low a weight as possible.

Figure 2:
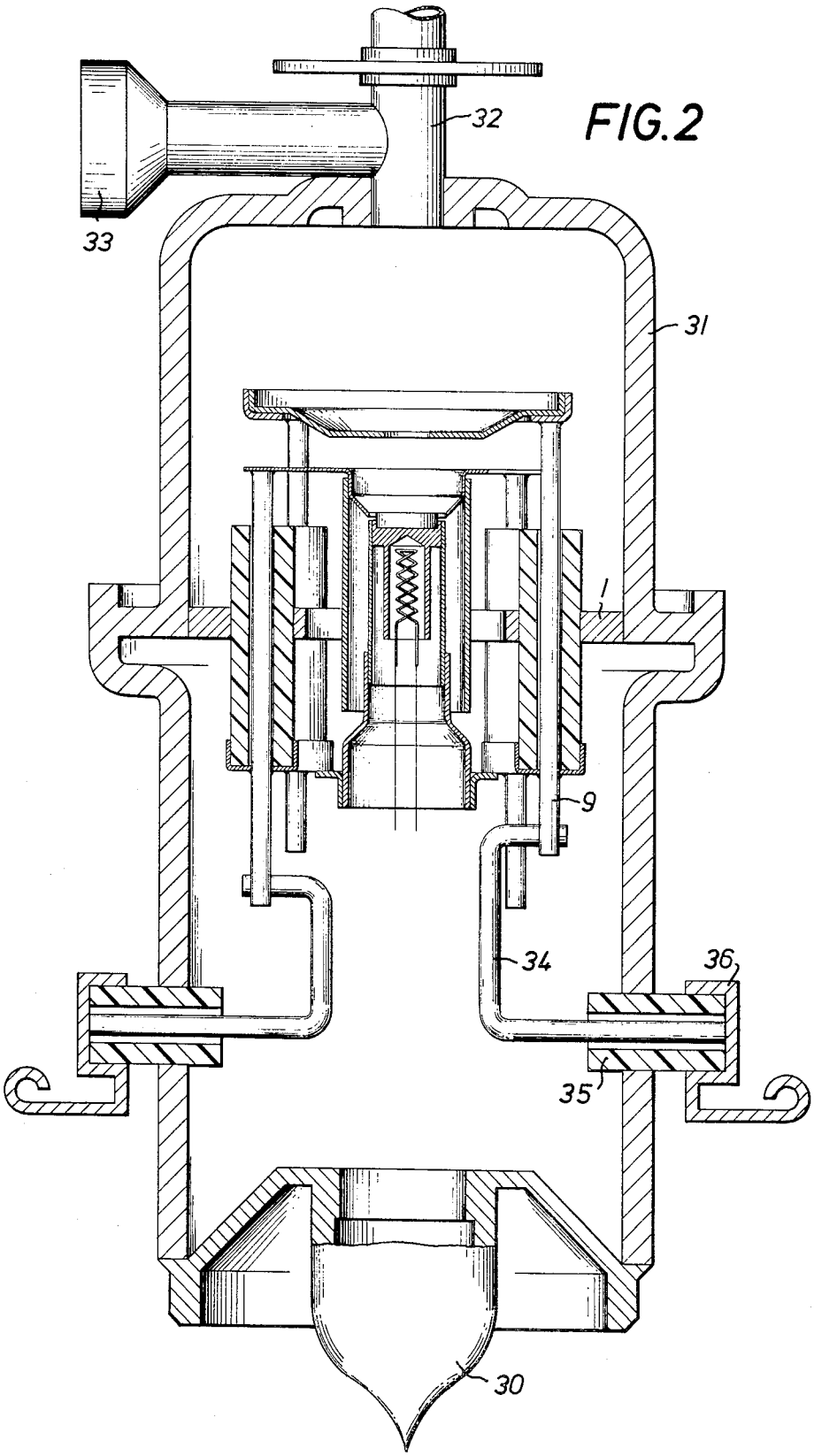
FIG. 2 is an elevation cross-sectional view of the system of FIGS. 1*a* and 1*b* in an envelope.

Advisably bores 19 are disposed in metal disc 1 to facilitate passage of gas during evacuation of the tube when the electron beam generating system is installed in the vacuum envelope of the traveling field tube as shown in FIG. 2. Voltage input leads for operation of the system are welded to the extended ends 20 or 20', respectively, of the circular rods 9, as can be seen in FIG. 1*a*.

FIG. 2 shows to a smaller scale the electron beam generating system of FIG. 1 which is fastened inside part of an evacuated envelope 31 so that the outer periphery of metal disc 1 is fastened directly to the metal wall of the envelope. The tube may be evacuated via a pump stud 30.

The electron beam produced by the electron beam generating system then enters into the delay line section 32 of the traveling field tube. The delay line is provided with a frequency coupling 33. Electrical leads 34 are welded to rods 9 and pass through vacuum-tight passages 35 through the vacuum wall to constitute contacts 36 outside of the tube.

An embodiment of the present invention which is particularly resistant to shock stresses and shock influences is one in which the center of gravity S of the electron beam generating system and the center of gravity S of the metal disc 1 substantially coincide or at least lie in the plane of extension of the metal disc which substantially passes through the center of gravity S of the metal disc 1.

The materials and dimensions of the various components of the system shown in FIGS. 1*a* and 1*b* will be selected on the basis of known electrical and thermal consideration in accordance with well-known standard practices in the art. In the preferred embodiment where the centers of gravity S both of the metal disc and the beam generating system coincide or lie in the median plane of the metal disc passing through its center of gravity, an improved shock resistance will be achieved because especially those shock forces will be reduced which will cause a twisting of the beam generating system axis relative to the tube axis.

It will be understood that the above description of the present invention is susceptible to various modifications, changes and adaptations, and the same are intended to be comprehended within the meaning and range of equivalents of the appended claims.

What is claimed is:

1. In an electron beam generating system including a cathode, a Wehnelt electrode, an anode, three groups of at least two electrically conductive rods, the rods of each group being connected to a respective one of the cathode, the Wehnelt electrode and the anode, a plurality of electrically insulating members each holding a respective rod, and a metal disc to which the insulating members are fastened in a manner to insulate each rod from the disc and from the other rods, the improvement wherein: said disc is in the form of a circular ring provided with a central opening and at least six additional openings disposed around the central opening; said insulating members are tubular members each having a central bore and each projecting from both sides of said disc; and each said rod is inserted in the bore of a respective insulating member, and extends at least partially through, and is fastened to, its respective insulating member.

2. An arrangement as defined in claim 1 wherein said tubular insulating members are made of a ceramic material and are fastened to said metal disc by soldering.

3. An arrangement as defined in claim 1 further comprising a plurality of annular metal caps each fastening a respective one of said rods to its associated insulating member.

4. An arrangement as defined in claim 1 wherein each said insulating member has a length substantially greater than the thickness of said metal disc.

5. An arrangement as defined in claim 1 wherein said conductive rods are arranged to extend parallel to the axis of the electron beam generated by said system.

6. An arrangement as defined in claim 1 wherein said system is constructed in a manner such that the center of gravity of said metal disc approximately coincides with that of said electron beam generating system.

7. An arrangement as defined in claim 1 wherein said metal disc is arranged to hold said system within a vacuum envelope of an electron beam tube.

8. An arrangement as defined in claim 1 wherein each said group of rods is constituted by three rods, and there are nine of said additional openings distributed around said metal disc to be symmetrical with the axis of the electron beam generated by said system.

9. An arrangement as defined in claim 1 wherein each said rod is fastened to only one end of its respective insulating member.

10. An arrangement as defined in claim 1 wherein said metal disc is provided with further openings which facilitate evacuation of gas from an envelope in which said system is to be housed.

11. An arrangement as defined in claim 1 wherein said system is part of a microwave tube.

* * * * *